US011098603B2

(12) United States Patent
Albers

(10) Patent No.: US 11,098,603 B2
(45) Date of Patent: Aug. 24, 2021

(54) INNER RING FOR A TURBOMACHINE, VANE RING WITH AN INNER RING, TURBOMACHINE AND METHOD OF MAKING AN INNER RING

(71) Applicant: MTU Aero Engines AG, Munich (DE)

(72) Inventor: Lothar Albers, Munich (DE)

(73) Assignee: MTU Aero Engines AG, Munich (DE)

( * ) Notice: Subject to any disclaimer, the term of this patent is extended or adjusted under 35 U.S.C. 154(b) by 287 days.

(21) Appl. No.: 16/293,897

(22) Filed: Mar. 6, 2019

(65) Prior Publication Data

US 2019/0277148 A1 Sep. 12, 2019

(30) Foreign Application Priority Data

Mar. 7, 2018 (DE) ..... 10 2018 203 442.7

(51) Int. Cl.

| | |
|---|---|
| ***F01D 9/04*** | (2006.01) |
| ***F01D 25/16*** | (2006.01) |
| ***F01D 17/16*** | (2006.01) |
| *F01D 11/00* | (2006.01) |

(52) U.S. Cl.

CPC ..... *F01D 9/042* (2013.01); *F01D 17/162* (2013.01); *F01D 25/162* (2013.01); *F01D 11/001* (2013.01); *F05D 2220/32* (2013.01); *F05D 2240/12* (2013.01); *F05D 2240/50* (2013.01); *F05D 2250/10* (2013.01)

(58) Field of Classification Search

CPC ..... F01D 9/042; F01D 17/162; F01D 25/162; F01D 11/001; F01D 17/167; F05D 2220/32; F05D 2240/12; F05D 2240/50; F05D 2250/10

See application file for complete search history.

(56) References Cited

U.S. PATENT DOCUMENTS

| | | | | |
|---|---|---|---|---|
| 5,915,919 | A | 6/1999 | Taillant et al. | |
| 2003/0113204 | A1* | 6/2003 | Wolf | F01D 25/16 415/165 |
| 2007/0020092 | A1* | 1/2007 | Giaimo | F04D 27/0246 415/160 |

(Continued)

FOREIGN PATENT DOCUMENTS

| | | | |
|---|---|---|---|
| DE | 69505074 | T2 | 3/1999 |
| DE | 102012220249 | A1 | 5/2014 |

(Continued)

*Primary Examiner* — Aaron R Eastman

(74) *Attorney, Agent, or Firm* — Barlow Joseph and Holmes Ltd; David Josephs

(57) ABSTRACT

The invention relates to an inner ring for a guide vane assembly for mounting adjustable guide vanes of a turbomachine, of a compressor stage or turbine stage of a gas turbine, a guide vane assembly for a turbomachine having an inner ring, a turbomachine having an inner ring, and a method for producing an inner ring, wherein the inner ring has a plurality of guide vane bearing mounts, which are each arranged spaced apart in the peripheral direction, recesses, which are each formed for receiving a bearing element, a bearing journal, of a guide vane, wherein, between at least two adjacent guide vane bearing mounts, the inner ring has at least one depression with a wall thickness in a radial direction that is reduced in comparison to a region that abuts the depression and is outside of the depression.

15 Claims, 3 Drawing Sheets

(56) References Cited

U.S. PATENT DOCUMENTS

Figure 1:
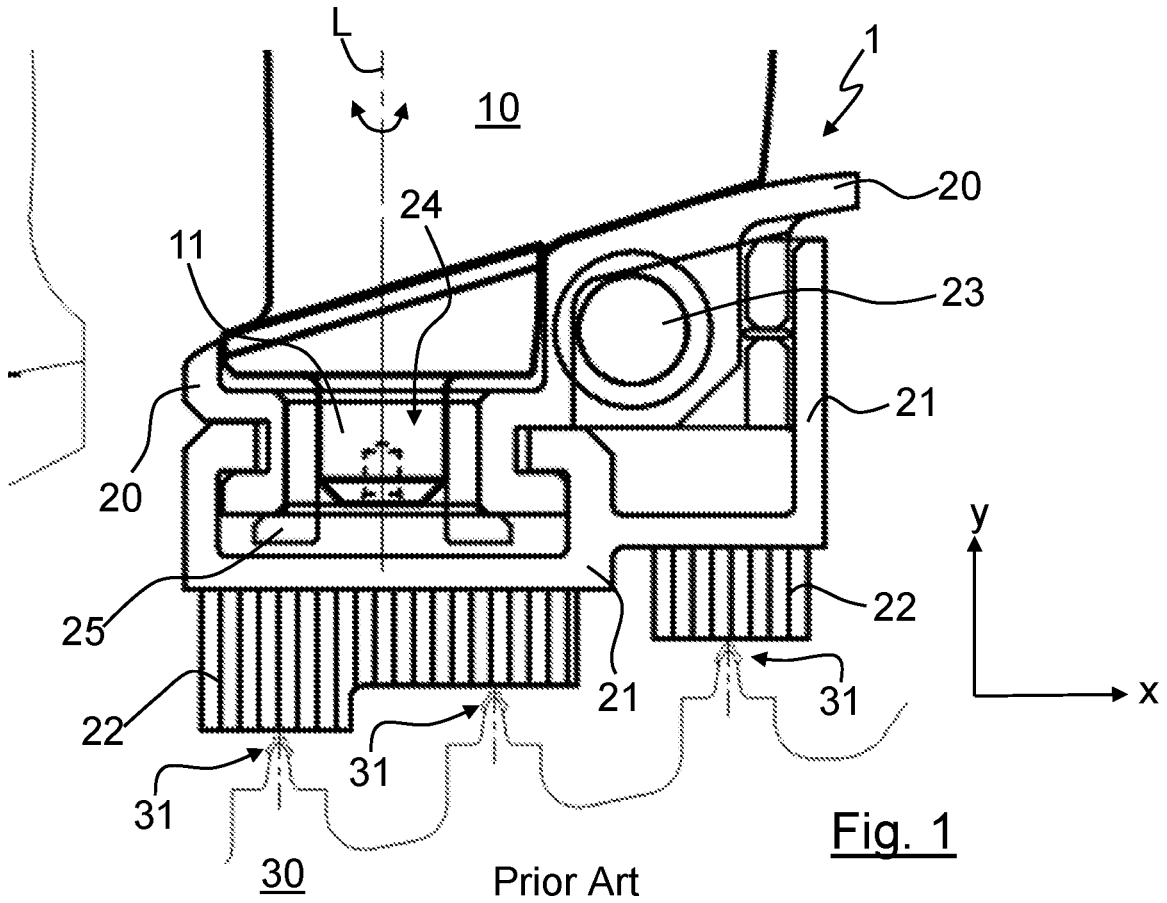

| | | | | |
|---|---|---|---|---|
| 2009/0208338 | A1* | 8/2009 | Major | F01D 17/162<br>416/215 |
| 2015/0275916 | A1* | 10/2015 | Marshall | B33Y 80/00<br>415/148 |
| 2016/0146027 | A1* | 5/2016 | Humhauser | F01D 9/042<br>415/148 |
| 2016/0208637 | A1* | 7/2016 | Maliniak | F01D 25/16 |
| 2017/0159467 | A1* | 6/2017 | Albers | F01D 9/041 |
| 2017/0159471 | A1* | 6/2017 | Albers | F01D 11/003 |
| 2017/0261003 | A1* | 9/2017 | Mouton | F04D 29/563 |
| 2018/0058263 | A1* | 3/2018 | Albers | F01D 5/303 |

FOREIGN PATENT DOCUMENTS

| | | | |
|---|---|---|---|
| EP | 2835499 | A1 | 8/2003 |
| EP | 3032037 | A1 | 6/2016 |
| EP | 3176385 | A1 | 6/2017 |
| EP | 3287604 | A2 | 2/2018 |
| FR | 2953487 | A1 | 6/2011 |
| WO | 2014078121 | A1 | 5/2014 |
| WO | 2015050676 | A1 | 4/2015 |

* cited by examiner

INNER RING FOR A TURBOMACHINE, VANE RING WITH AN INNER RING, TURBOMACHINE AND METHOD OF MAKING AN INNER RING

BACKGROUND OF THE INVENTION

The present invention relates to an inner ring for a guide vane assembly for mounting guide vanes, in particular adjustable guide vanes, of a turbomachine, in particular of a compressor stage or turbine stage of a gas turbine, a guide vane assembly, and a turbomachine, in particular a gas turbine having such an inner ring as well as a method for the production thereof.

During the operation of turbomachines having inner rings of this kind, the inner rings are generally subjected to thermal loads, in particular partially fluctuating and/or high temperature gradients, in particular due to the working fluid flowing through the guide vane assembly and thus at least partially flowing around the inner ring, and/or due to sliding seals between the guide vane assembly and a rotor that rotates relative to the guide vane assembly. The thermal load can result in undesired, thermally caused deformations of the inner ring, in particular the widening of gaps and, in consequence thereof, undesired leakages, which can have a detrimental effect on the efficiency of the turbomachine.

Generic inner rings are fundamentally known from prior art—for example, from FR 2 953 487—whereby FR 2 953 487 teaches the use of a polygonally shaped inner ring that, between the bearing mounts for the guide vanes, has reinforcing elements, in particular, reinforcing ribs, which, in relation to the inner ring, extend outward in the radial direction and in the peripheral direction in a functional installed state in a turbomachine.

SUMMARY OF THE INVENTION

An object of one embodiment of the present invention is to provide an improved inner ring.

This object is achieved by an inner ring, by a guide vane assembly, by a turbomachine, in each case with (at least) one inner ring described here, as well as by a method for producing an inner ring described here and in accordance with the present invention. Advantageous embodiments of the invention are discussed in detail below.

In accordance with one embodiment of the present invention, an inner ring for a guide vane assembly for mounting guide vanes, in particular adjustable guide vanes, of a turbomachine, in particular of a compressor stage or turbine stage of a gas turbine, has a plurality of guide vane bearing mounts, arranged spaced apart from one another in each case in the peripheral direction, in particular recesses, each of which is formed for receiving a bearing element, in particular a bearing journal, of a guide vane. In this case, between at least two adjacent guide vane bearing mounts, the inner ring has at least one depression with a wall thickness that is reduced in a radial direction in comparison to a region that abuts the depression outside of the depression.

In accordance with the invention, the depression, in particular the at least one depression, has a greater extent or dimension in the axial direction than in the peripheral direction in relation to an axis of rotation of a turbomachine in a functionally installed state of the inner ring in a turbomachine.

In the present case, in the technically conventional way, the directional specification "axially" refers to a direction parallel to the rotational axis or (main) machine axis of the turbomachine; the directional specification "peripheral direction" correspondingly refers to a rotational direction around this rotational or (main) machine axis, and the directional specification "radially" refers to a direction that is perpendicular to the axial and peripheral directions. The directional specification "tangentially" correspondingly refers to a direction that is perpendicular to the axial direction and the radial direction, whereby, in particular, all directional specifications each refer to a functionally installed state in a turbomachine in regard to an inner ring according to the invention and/or a guide vane assembly according to the invention.

In the sense of the present invention, "guide vane bearing mounts" are, in particular recesses or pockets, in particular recesses or pockets like blind holes or through holes, in which guide vanes can be radially supported and/or rotatably mounted.

In the present case, in the sense of the present invention, "depression" is understood to mean, in particular, a local indentation or hollow or the like in a radial direction.

Through one depression or a plurality of depressions of this kind, it is possible in one embodiment of the present invention to achieve an improved temperature distribution in the inner ring, in particular a more advantageous temperature profile in a radial direction. In particular, through the depression(s), it is possible to influence and, in particular, to reduce any thermally caused motion and/or deformation of the inner ring during operation, and thus, in particular, to influence and, in particular, to reduce any change in its shape, particularly its diameter and/or its roundness.

In one embodiment of the invention, it is thereby possible, in particular, to reduce any sealing effect between the guide vanes and the inner ring in the region of the guide vane bearing mounts and/or between the guide vane assembly and the rotor and/or an inlet, and thus to improve the operating performance, in particular the efficiency, of a turbomachine.

Through one depression or a plurality of depressions of this kind, it is possible in one embodiment of the present invention to reduce, in particular, the undesired so-called "cording effect."

In the sense of the present invention, the "cording effect" is understood to mean a three-dimensional, thermally caused deformation of the inner ring, in particular a thermally caused creation of constrictions of the inner ring, which, in particular in the case of divided inner rings, can arise at the dividing planes and which, in particular, are created by a transient, radial temperature profile due to the different heating times of the inner ring on the side of the guide vanes, which are heated directly and thereby rapidly by the working fluid, and the side facing away from the guide vanes, which heats up slowly.

The different heating times of the inner ring on the side of the guide vanes and on the side facing away from the guide vanes can result in different, thermally caused expansions of the material and, in particular, in a stronger expansion of the material on the side facing the guide vanes than on the side facing away from the guide vanes, and thus in a thermally caused deformation of the inner ring, similarly to the case of a bimetal. This deformation can result, in particular, in the widening of gaps and, in consequence thereof, in undesired leakages, which can have a detrimental effect on the efficiency of the turbomachine.

Through the depression(s) in accordance with the invention, the cross-sectional area of the inner ring, in particular a wall thickness of the inner ring, is locally reduced, particularly in the radial and/or axial direction(s) and/or in the peripheral direction, depending on the design of the depression. In one embodiment of the invention, it is thereby advantageously possible to achieve an improved, transient heating behavior of the inner ring, because less material of the inner ring needs to be heated. In particular, in one embodiment of the invention, it is possible to achieve an improved, transient temperature profile in the radial direction, and, in particular, a temperature profile with a smaller temperature gradient in the radial direction, as a result of which, particularly in the case of a suitable design of depression(s), a heating behavior of the inner ring that is improved with respect to the "cording effect" and, in particular, reduces the "cording effect" can be achieved.

In some embodiments of the present invention, it is thereby possible, in turn, to reduce or even to entirely prevent any undesired widening of gaps, in particular any ovalization of the guide vane bearing mounts and/or to reduce or even to entirely prevent any run-in of sealing fins into the one sealing structure of a seal carrier, as a result of which leakages can be reduced, and, as a result, the efficiency of the turbomachine can be improved, and/or a specific fuel consumption can be lowered, and/or, in the case of a turbomachine constructed as a compressor, a pump limit can be increased.

In the sense of the present invention, a "pump limit" is understood here to mean a stable volume flow that is minimally required in order to attain a desired compression ratio, whereby, as a rule, a higher compression is possible with increasing volume flow.

In one embodiment of the invention, a smaller leakage enables a higher, stable volume flow to be achieved. In this way, it is possible to achieve a higher compression ratio, so that as a result, a reduction in leakages can lead to a higher compression ratio.

Furthermore, as a result of the locally reduced wall thickness of the inner ring due to the depression(s) in accordance with the invention, the bending stiffness of the inner ring is further diminished, in particular in the peripheral direction, whereby, in one embodiment of the invention, an improvement, in particular, a further improvement, of the "cording properties" and, in particular, a (further) reduction of the "cording effect" can be achieved.

In particular, it is possible in this way to provide a guide vane assembly having a more flexible inner ring and a more rigid seal carrier, as a result of which it is possible, as has been found, to reduce the "cording effect" especially well.

Furthermore, through the depression(s) in accordance with the invention, it is possible to achieve a reduction in the weight of the inner ring and thus of a guide vane assembly as well as of a turbomachine.

In one embodiment of the present invention, the inner ring is designed in such a way and, in particular, the depressions of the inner ring are designed in such a way that the inner ring has a bending stiffness that is reduced by at least 10%, in particular by at least 15%, particularly in the peripheral direction, in comparison to an inner ring without depressions.

In one embodiment of the present invention, the inner ring has, in particular, a plurality of depressions, in particular a plurality of depressions that are each arranged on a side of the inner ring that faces away from the guide vanes, wherein the depressions are arranged, in particular, at least largely equidistantly distributed over the periphery of the inner ring.

In one embodiment of the present invention, it is thereby possible to achieve an especially advantageous heating behavior and/or an advantageous reduction in the bending stiffness of the inner ring.

In one embodiment of the present invention, exactly one depression is provided, in particular at least between two adjacent guide vane bearing mounts or adjacent groups of guide vane bearing mounts, in particular in each case. That is, in other words, in one embodiment of the invention, the inner ring has exactly one depression, in particular between at least one pair of adjacent pairs of guide vane bearing mounts or one pair of adjacent groups of guide vane bearing mounts, in particular exactly one depression between two guide vane bearing mounts or two groups of guide vane bearing mounts in each case.

In one embodiment of the present invention, it is thereby possible to achieve an especially advantageous heating behavior and/or an advantageous reduction in the bending stiffness of the inner ring, in particular an advantageous, in particular more uniform, heating behavior over the entire periphery of the inner ring or a uniform (more uniform) bending stiffness of the inner ring in the peripheral direction.

In one embodiment of the present invention, in particular at least one depression is arranged, in relation to a functionally installed state of the inner ring in a turbomachine, on a side of the inner ring that faces away from the guide vanes, in particular in an inner-lying surface of the inner ring in the radial direction, in particular in an inner shell surface of the inner ring.

In one embodiment of the present invention, it thereby possible, in particular, to achieve a more rapid heating of the inner side of the inner ring and, in consequence thereof, a temperature distribution in the radial direction that is especially advantageous in regard to the "cording effect," in particular a more rapid heating of the side of the inner ring facing away from the guide vanes, in relation to a functionally installed state in a turbomachine.

In an alternative, in particular additional, embodiment of the present invention, the inner ring can also be introduced with at least one surface of the inner ring that faces the guide vanes.

In one embodiment of the present invention, the peripheral contour of at least one depression extends, in particular, at least partially parallel to a peripheral contour of an adjacent recess, in particular in a region of the peripheral contour that extends essentially in the axial direction of the inner ring, in relation to a functionally installed state in a turbomachine, wherein the peripheral contour extends, in particular, at least partially parallel to the peripheral contours of both adjacent recesses. It is thereby possible to achieve an especially advantageous thermal behavior of the inner ring. This results advantageously in delimiting webs between the depressions and the recesses, whereby, in particular, said delimiting webs can have a constant thickness, preferably at least partially, along their longitudinal extent.

In the sense of the present invention, the term "parallel" is understood here to mean "with constant separation", in particular in connection with the peripheral contour of a depression.

In one embodiment of the present invention, the peripheral contour of at least one depression extends, in particular, at least partially parallel to a contour of the inner ring in the peripheral direction of the inner ring, in particular in a region of the peripheral contour that extends essentially in the peripheral direction of the inner ring, in relation to a functionally installed state in a turbomachine. It is thereby possible to achieve an especially advantageous thermal behavior of the inner ring.

In one embodiment of the present invention, in particular at least one depression has a bone-shaped, bone-shape-like, hourglass-shaped, or hourglass-shape-like peripheral contour, in particular in relation to a projection of the peripheral contour of the depression in a tangential plane of the inner ring. It has been found that, in this way, it is possible to achieve an especially advantageous thermal behavior of the inner ring, in particular an especially advantageous thermal motion and/or deformation of the inner ring, in particular a thermally caused motion/deformation of the inner ring that leads to an especially small out-of-roundness, and, in particular, to an especially small ovalization of the inner ring and/or the guide vane bearing mounts.

In one embodiment of the present invention, the peripheral contour is designed here to be, in particular, symmetrical or asymmetrical in and/or towards an axial direction.

In the sense of the present invention, a "tangential plane" is understood to mean a plane that is perpendicular to the radial direction, in particular a plane that extends perpendicularly to an associated radius.

In one embodiment of the present invention, in particular at least one depression has a completely closed peripheral contour or a peripheral contour that is open at least at one axial end, in particular only at one axial end. A depression having a peripheral contour that is open at its axial ends can be produced especially simply, in particular by machining. A depression having a completely closed peripheral contour leads, as a rule, to a smaller leakage than does a comparable depression having a peripheral contour that is open at an axial end, because, in particular, the peripheral contour that is closed at the axial ends reduces or prevents any flow of the working fluid from the guide vane side through the open end into the depression on the side of the inner ring that faces away from the guide vanes.

In one embodiment of the present invention, in particular at least one depression has a bottom surface, wherein, in particular at least in the region of the bottom surface, the depression has at least partially, in particular over the entire bottom surface, a constant depth, in particular in such a way that, in the region of the bottom surface, the inner ring has, in particular, a constant wall thickness and/or an inner contour with a constant radius in relation to the (main) machine axis or the rotational axis of the turbomachine in relation to a functionally installed state of the inner ring in a turbomachine. In this way, it is possible in an especially simple way to achieve an effective reduction in the wall thickness and, in particular, at the same time, an advantageous thermal behavior of the inner ring.

In one embodiment of the present invention, the depth of at least one depression is chosen here to be as large as possible and, in consequence thereof, the wall thickness is minimized, in particular locally in the region of the depression and/or in a region abutting the depression.

In one embodiment of the present invention, the inner ring is formed in one part. In another embodiment of the present invention, the inner ring is formed in several parts and, in particular, is divided in the peripheral direction and/or in the axial direction.

If, in one embodiment of the present invention, the inner ring is divided in the peripheral direction, it has, in particular, a plurality of inner ring segments and, in particular, is composed of a plurality of inner ring segments, and, in particular, is composed of at least two inner ring segments, which, in this case, preferably each extend over a peripheral angle of about and, in particular, exactly 180°, or is composed of three inner ring segments, which preferably each extend over a peripheral angle of about and, in particular, exactly 120°. In an enhancement of this embodiment, in one embodiment of the present invention, every two inner ring segments that abut each other in the peripheral direction are coupled in this case to each other and, in particular joined to each other at their contact surfaces, in particular by use of at least one connecting journal or connecting pin that extends in the peripheral direction.

Alternatively or additionally to a division in the peripheral direction, the inner ring or at least one inner ring segment can be divided in the axial direction, wherein the division extends, in particular, over the entire length of the inner ring or of the inner ring segment in the peripheral direction and, in particular, extends in a common radial plane through the inner ring or the associated inner ring segment. In an enhancement of this embodiment, in one embodiment of the present invention, the individual ring parts are coupled here to each other and, in particular, joined to each other by use of at least one connecting journal or connecting pin that extends in the axial direction.

In one embodiment of the present invention, in particular at least one depression, particularly all depressions, are introduced into the inner ring by means of a separating manufacturing method, in particular by means of a mechanical processing, in particular by machining, particularly by metal cutting with a geometrically defined cutter, in particular by milling. In this way, it is possible to introduce the depressions in the inner ring in an especially simple manner. In particular, it is possible in this way to introduce depressions very simply and precisely.

A guide vane assembly according to the invention for a turbomachine, in particular a compressor stage or turbine stage of a gas turbine having an inner ring and guide vanes, in particular adjustable guide vanes, to which the inner ring is fastened, has a previously described inner ring that is formed in accordance with the present invention.

In one embodiment of the present invention, at least one guide vane is joined to the inner ring by means of a bearing journal that extends in a radial direction, the vane being inserted in a correspondingly formed guide vane bearing mount of the inner ring and, in particular, is supported at the inner ring in a radial direction, in particular being rotatably mounted around a longitudinal axis in the inner ring. Preferably, between the inner ring and the bearing journal, a receiving socket is further provided.

In one embodiment of the present invention, the guide vane assembly additionally has, in particular, a seal carrier or a seal carrier segment, wherein the seal carrier or the seal carrier segment is arranged, in particular, on the side facing away from the guide vanes and, in particular, covers at least partially, and in particular completely, at least one depression arranged in a surface facing away from the guide vanes.

A turbomachine according to the invention, in particular a gas turbine, with at least one compressor stage or turbine stage having an inner ring has an inner ring that is formed as previously described in accordance with the present invention.

In one embodiment of the present invention, a turbomachine has, in particular, one compressor stage and/or turbine stage or a plurality of compressor stages and/or turbine stages. One of these compressor stages and/or turbine stages or a plurality of these compressor stages and/or turbine stages has or have, in particular, a row of rotating blades and a row of guide vanes in each case, wherein, in particular, one of these guide vane rows or a plurality of these guide vane rows has or have a guide vane assembly according to the invention.

In an especially advantageous embodiment, the invention is used in gas turbines, in particular in gas turbine engines, in particular in a high-pressure compressor and/or in a low-pressure compressor.

In one embodiment of the present invention, therefore, the turbomachine is, in particular, a compressor, particularly a high-pressure compressor or low-pressure compressor.

In one embodiment of a method according to the present invention, an inner ring according to the invention is produced in that at least one depression of the inner ring, in particular all of the depressions, is or are produced by a separating fabrication method, in particular by a mechanical processing, in particular by machining, in particular by metal cutting with a geometrically defined cutter, in particular by milling.

BRIEF DESCRIPTION OF THE DRAWING FIGURES

Figure 2:
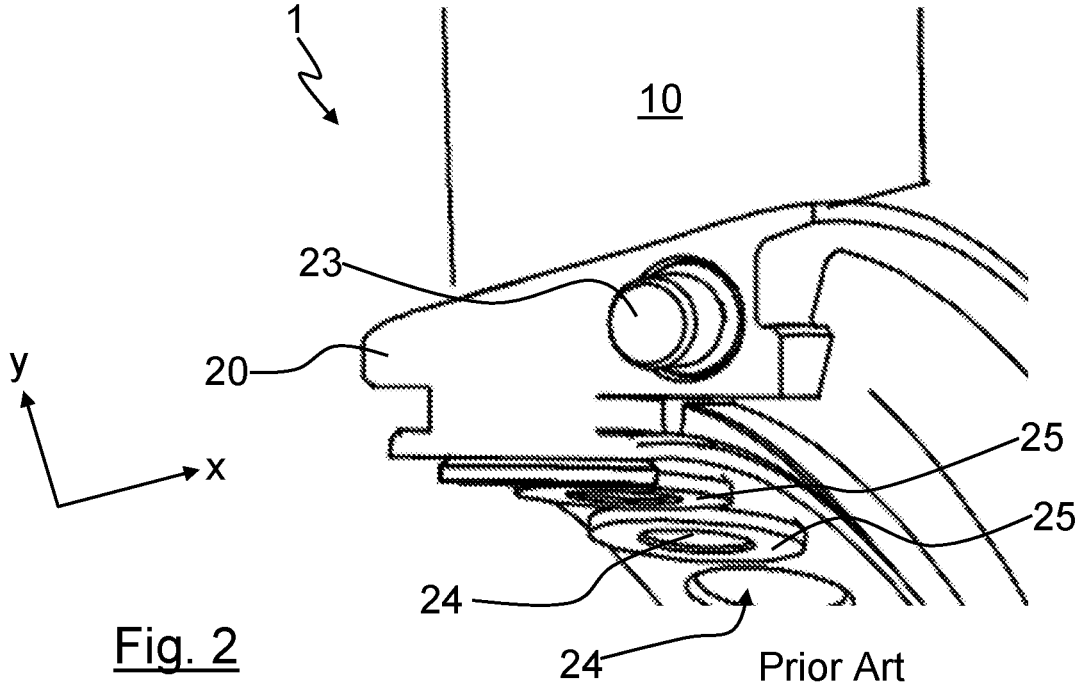
Figure 3:
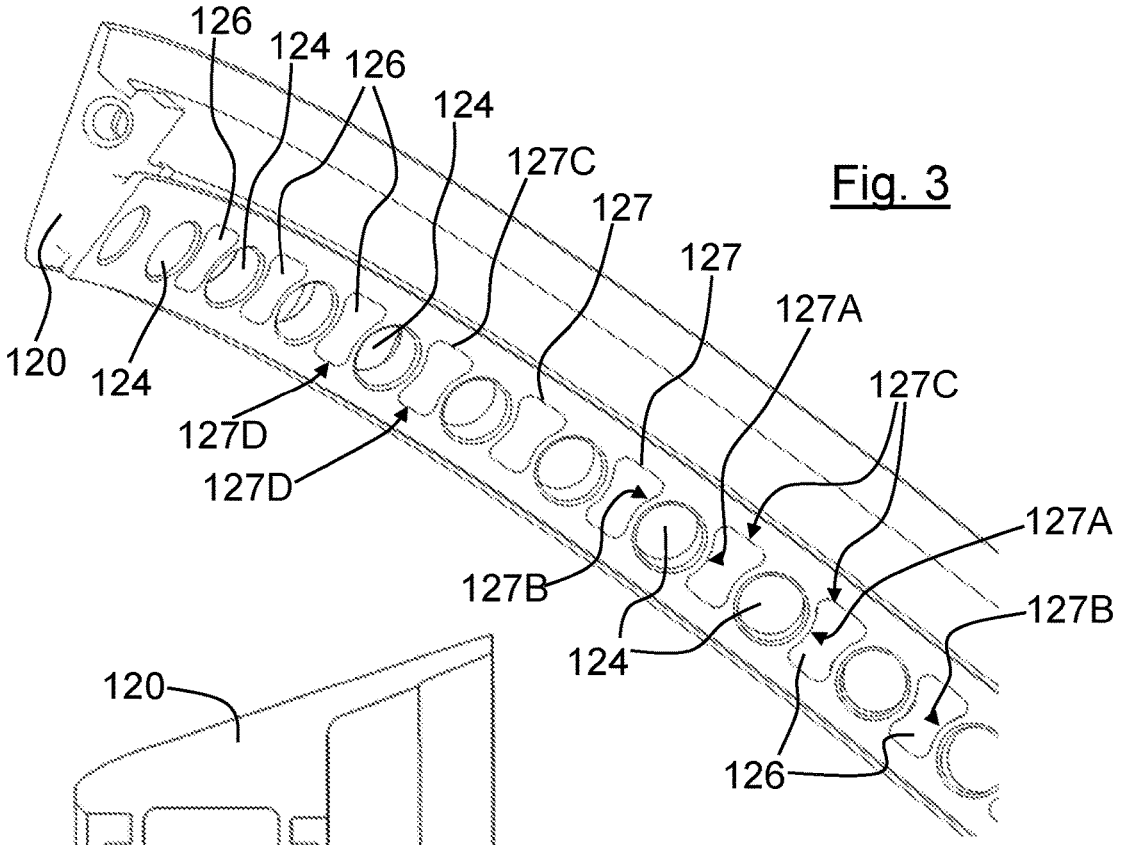
Figure 4:
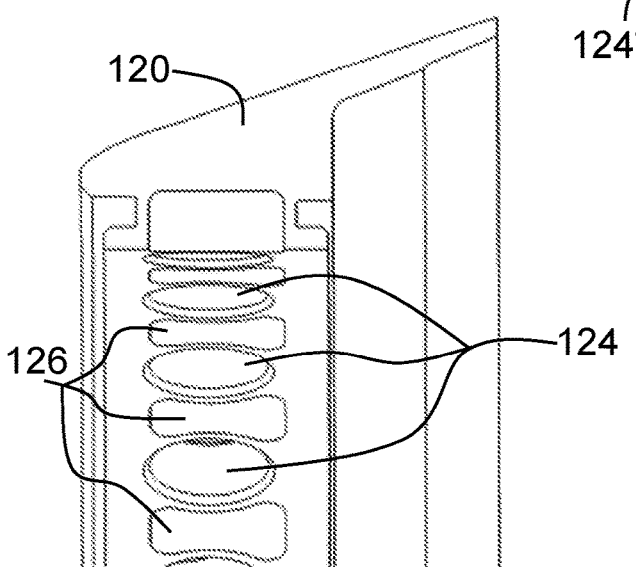
Figure 5:
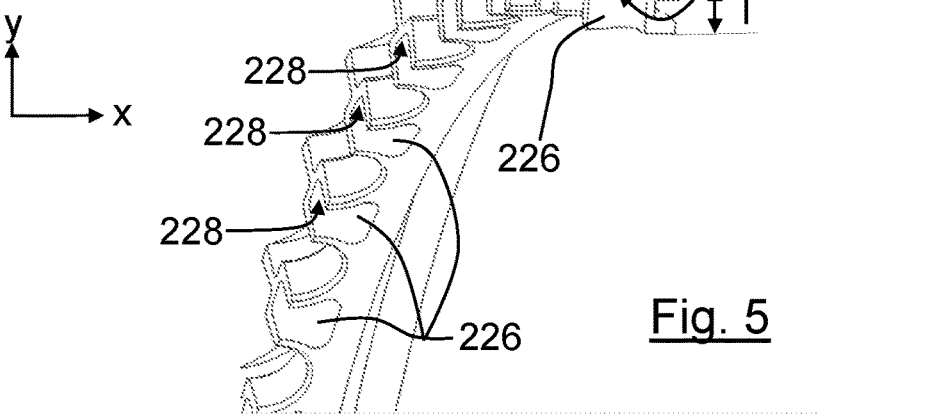
Figure 6:
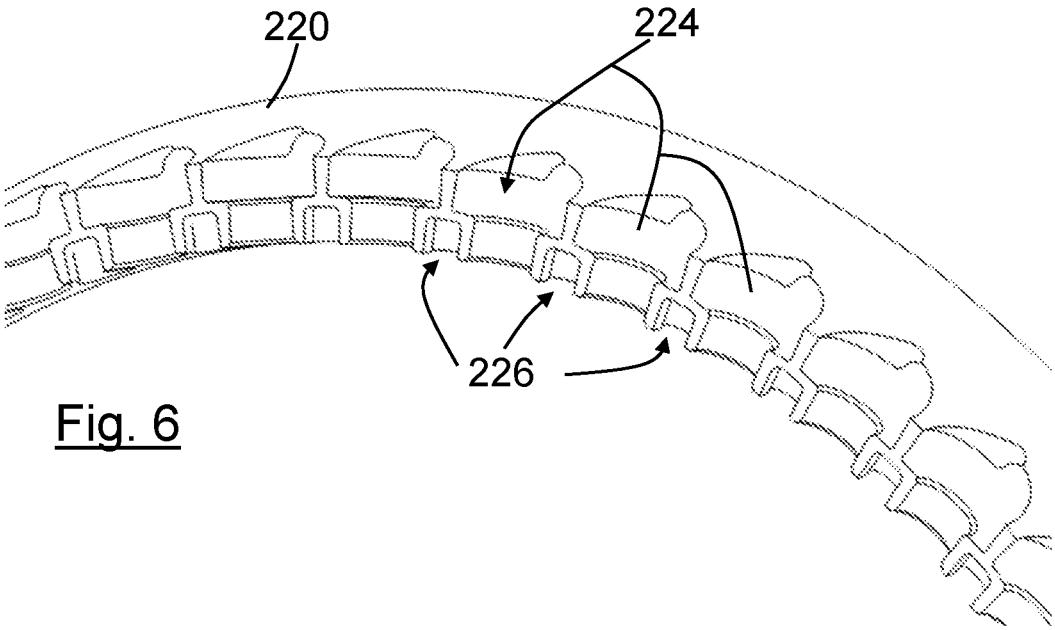
Figure 7:
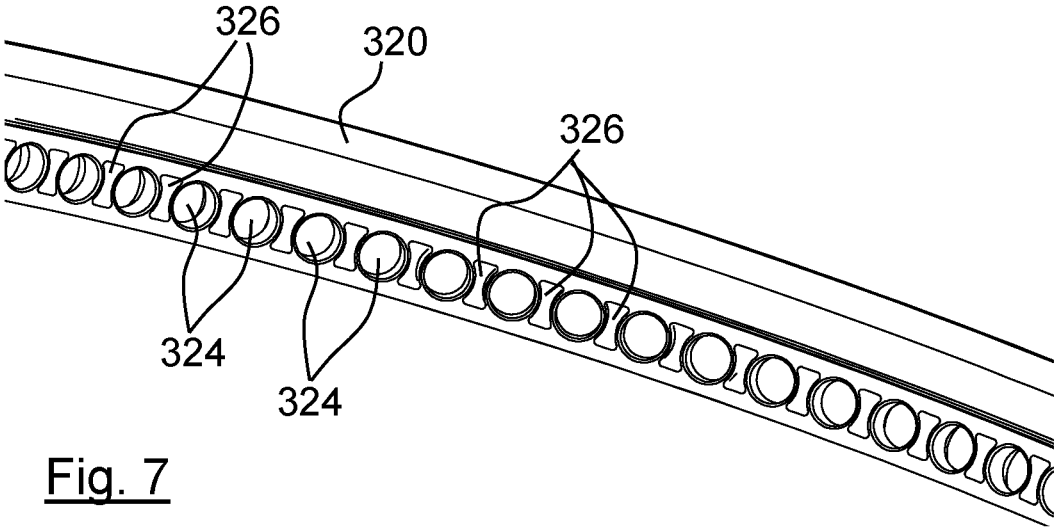

Additional advantageous enhancements of the present invention ensue from the dependent claims and the following description of preferred embodiments. Shown for this purpose in a partially schematic manner are:

FIG. 1 shows a cutout of a guide vane assembly segment of a turbomachine, which is designed as a compressor and is known from prior art, in the region of an inner ring in a side view, FIG. 2 shows a cutout of the guide vane assembly segment from FIG. 1 in a perspective illustration, FIG. 3 shows a cutout of a first exemplary embodiment of an inner ring segment of an inner ring according to the invention in a perspective illustration in a view from radially inward, FIG. 4 shows the inner ring segment from FIG. 3 in a view from radially inward, FIG. 5 shows a cutout of an inner ring segment of a second exemplary embodiment of an inner ring according to the invention in a perspective illustration, FIG. 6 shows the inner ring segment from FIG. 5 in another perspective illustration, and FIG. 7 shows a cutout of a third exemplary embodiment of an inner ring according to the invention in a perspective illustration.

DESCRIPTION OF THE INVENTION

For better understanding of the invention, FIG. 1 shows a cutout of a generic guide vane assembly 1 of a turbomachine, which is known from prior art and has an inner ring segment 20, in the region of the inner ring segment 20 in a side view.

The guide vanes 10 are mounted on the inner ring segment 20 in a way that is known from prior art, whereby, to this end, the inner ring segment 20 has guide vane bearing mounts 24, which are arranged uniformly distributed in the peripheral direction and are designed, in particular, as through openings, wherein the guide vanes 10 are joined to the inner ring segment 20 via bearing journals 11 that extend in a radial direction y and are supported at the inner ring segment 20 in a radial direction.

In this case, the guide vanes 10 are adjustably formed and joined to the inner ring segment 20 so as to rotate around a longitudinal axis L. For minimization of the friction between the bearing journal 11 and the inner ring segment 20, a bushing 25 is introduced into the through hole for the guide vane bearing mount 24 in each case.

For sealing with respect to the rotatably mounted rotor 30 of the turbomachine, the guide vane assembly 1 further has a seal carrier segment 21 that is fastened to the inner ring segment 20 on a side facing away from the guide vanes 10, wherein the seal carrier segment 21 is likewise arranged in a known way at the inner ring segment 20, wherein in this case, in particular for promoting a high sealing effect, the guide vane bearing mounts 24, which are formed as through holes, are covered by the seal carrier segment 21 on a side of the inner ring that faces away from the guide vanes 10.

For a further improvement of the sealing effect, a sealing structure 22, in particular a honeycomb-shaped sealing structure 22, is provided at a radial inner side of the seal carrier segment 21 and interacts with so-called sealing fins 31, which are fastened at the rotor, extend outward in a radial direction from the rotor, and seal a gap between guide vane assembly or guide vane assembly segment 1, which is in fixed arrangement at the housing, and the rotatably mounted rotor 30 of the turbomachine in order to reduce flow losses due to leakages during flow around the guide vane 10 and, in particular, to bring about a reduction of the volume flows in the region of the guide vanes 10.

The guide vane assembly segment 1 is hereby a part of a guide vane assembly that is divided in the peripheral direction into a plurality of guide vane assembly segments 1, wherein each guide vane assembly segment 1 has an inner ring segment 20 and a corresponding seal carrier segment 21. For connection of the individual guide vane assembly segments to one another in the peripheral direction, in particular for connection of the individual inner ring segments 20 to one another in the peripheral direction, each inner ring segment 20 has a connecting journal 23 at one of its front sides in the peripheral direction and, at the other front side, a recess that is formed correspondingly to the connecting journal 23 and is not illustrated here.

FIG. 2 shows a cutout of the guide vane assembly segment from FIG. 1 in a perspective illustration, wherein, in this illustration, in particular the connecting journals 23 at the front side of the inner ring segment 20, the guide vane bearing mounts 24 formed as through holes, and the bushings 25 arranged in the through holes for the guide vane bearing mounts 24 can be seen especially well.

During operation of the turbomachine, working fluid flows around the guide vanes 10 in the axial direction x and, in consequence thereof, the inner ring or the individual inner ring segments 20 heats up or heat up, whereby the inner ring segments 20 hereby heat up more rapidly on their outer side owing to the working fluid that directly flows by than at their inner side, which faces away from the guide vanes 10 and faces the seal carrier segment 21, as a result of which a widening of gaps, in particular a widening of sealing gaps, occurs and, in consequence thereof, leakages occur.

FIG. 3 shows a cutout of a first exemplary embodiment of an inner ring segment 120 of a multipart inner ring according to the invention, which is divided in the peripheral direction, in a perspective illustration in a view from radially inward and FIG. 4 shows the inner ring segment 120 from FIG. 3 in a view from radially inward. The inner ring segment 120 of an inner ring formed in accordance with the invention, illustrated in FIG. 3 and FIG. 4, has a plurality of depressions 126, which are only indicated in the illustration and which, in particular, are arranged uniformly distributed in the peripheral direction and are introduced into an inner shell surface of the inner ring segment 120, wherein, in particular, exactly one depression is arranged between every two adjacent guide vane bearing mounts 124 of a pair of guide vane bearing mounts 124.

The depressions 126 in accordance with the invention result in a local reduction in the cross-sectional area of the inner ring segment 120 and, in particular, in a local reduction in the wall thickness of the inner ring segment 120. In this way, it is advantageously possible to achieve an improved, transient heating behavior of the inner ring segment 120 and, accordingly, of the entire inner ring, because less material of the inner ring needs to be heated. In particular, it is possible to achieve an improved, transient temperature profile in a radial direction y, in particular a temperature profile with a smaller thermal gradient in a radial direction y.

In accordance with the invention, the depressions 126 hereby have a larger extension in the axial direction x than in the peripheral direction. This results in an especially advantageous thermal behavior of the inner ring or of the inner ring segments 120 during operation of an associated turbomachine.

In this exemplary embodiment, the depressions 126 hereby each have a closed peripheral contour 127, wherein the peripheral contour in the region of their axial extension 127A and 127B extends parallel in each case, that is, with a constant separation, to a peripheral contour of the guide vane bearing mounts 124 and, in its segments 127C and 127D, which extend in the peripheral direction, extends parallel in each case to a peripheral contour of the inner ring segment 120.

The depressions 126 hereby have, in particular, an essentially bone-shaped peripheral contour 127 in relation to a projection in a tangential plane of the inner ring segment 120. Furthermore, the depressions 126 are formed symmetrically in the axial direction and extend, in particular locally, between two abutting and in particular adjacent guide vane bearing mounts 124 nearly completely over the region between these guide vane bearing mounts 124.

FIG. 5 shows a cutout of a second inner ring segment 220 of a second exemplary embodiment of an inner ring according to the invention in a perspective illustration. FIG. 6 shows the inner ring segment 220 from FIG. 5 in another perspective illustration, wherein this exemplary embodiment of an inner ring segment 220 of an inner ring according to the invention is part of an inner ring than is divided both in the peripheral direction and in the axial direction x, wherein a subplane hereby extends in the axial direction centrally all the way through the guide vane bearing mounts 224 and the depressions 226.

In this illustration, the depressions 126 in accordance with the invention, which likewise have an essentially bone-shaped peripheral contour that, in this case, however, is not identified in greater detail, can be seen especially well. The depressions 226 each have a bottom surface 228, wherein the individual depressions 226 in this exemplary embodiment each have a constant depth T over nearly the entire bottom surface 228 and thus a constant, local wall thickness in the region of the depressions 226.

FIG. 7 shows a cutout of a third exemplary embodiment of an inner ring according to the invention in a perspective illustration, wherein, in this exemplary embodiment, on account of the large number and, in particular, tighter arrangement of the guide vane bearing mounts 324, the depressions 326 extend over a smaller surface, but are otherwise formed similarly to the previously described exemplary embodiments.

All of the above-described exemplary embodiments of inner rings according to the invention share in common the fact that, in relation to a functionally installed state of the inner ring segments 120, 220, 320 or the associated inner rings, the depressions 126, 226, 326 are each arranged on a side of the inner ring that faces away from the guide vanes and, in particular, in an inner shell surface of the inner ring. Furthermore, all depressions 126, 226, 326 are each introduced by machining into the inner ring segments 120, 220, 320, in particular by milling.

It has been found that an embodiment of the depressions 126, 226, 326 of this kind enables an especially advantageous heating behavior of the inner ring segments 120, 220, 320 and, accordingly, of the associated inner ring to be achieved and, in particular, a heating behavior of the respective inner ring that is improved in regard to the "cording effect" and, in particular, a heating behavior that reduces the "cording effect." In consequence thereof, smaller leakages occur and this, in turn, has an advantageous effect on the efficiency and the specific fuel consumption of the compressor.

Furthermore, it is possible in this way, namely, in particular by means of the previously described depressions 126, 226, 326, to achieve a bending stiffness that is reduced by about 15% in comparison to a comparable inner ring without depressions, as a result of which a further improvement of the "cording effect" can be achieved.

Furthermore, the depressions 126, 226, 326 lead to an advantageous reduction in the weight of the inner ring and, accordingly, also to a reduction in the weight of the turbomachine.

It is noted that the exemplary embodiments are merely examples, which are not intended to limit the protective scope, the applications, and the structure in any way. Instead, the above description affords the person skilled in the art a guide for the implementation of at least one exemplary embodiment, with it being possible to make diverse modifications, in particular in regard to the function and arrangement of the described component parts, without leaving the protective scope as ensues from the claims and the combinations of features equivalent thereto.

What is claimed is:

1. An inner ring for a guide vane assembly for mounting adjustable guide vanes of a turbomachine, of a compressor stage or turbine stage of a gas turbine, wherein the inner ring has a plurality of guide vane bearing mounts, which are each arranged spaced apart from one another in a peripheral direction, recesses, which are each formed for receiving a bearing element, a bearing journal, of a guide vane, wherein, between at least two adjacent guide vane bearing mounts, the inner ring has at least one depression with a wall thickness that is reduced in a radial inward direction from a radial outermost surface of the inner ring in comparison to a region that abuts the depression and is outside of the depression, wherein, in relation to an axis of rotation of the turbomachine in a functionally installed state of the inner ring in a turbomachine, the depression has a larger extension in an axial direction than in the peripheral direction, and the region that abuts the depression is arranged at a radial height that is the same as the radial outermost surface of the inner ring and the region extends between the at least one depression and the recess defining a wall.

2. The inner ring according to claim 1, wherein the depression are a plurality of depressions that are each arranged on a side of the inner ring that faces away from the guide vanes, wherein the plurality of depressions are distributed, at least essentially equidistantly.

3. The inner ring according to claim 1, wherein at least between two adjacent guide vane bearing mounts or adjacent groups of guide vane bearing mounts, exactly one depression is provided in each case.

4. The inner ring according to claim 1, wherein, in relation to a functionally installed state of the inner ring in a turbomachine, at least one depression is arranged on a side of the inner ring that faces away from the guide vanes, in an inner-lying surface of the inner ring in a radial direction, in an inner shell surface of the inner ring.

5. The inner ring according to claim 1, wherein a peripheral contour of at least one depression extends at least partially parallel to a peripheral contour of an adjacent recess, in a region of the peripheral contour that extends in the axial direction of the inner ring, in relation to a functionally installed state in a turbomachine, wherein the peripheral contour extends at least partially parallel to the peripheral contours of both adjacent recesses.

6. The inner ring according to claim 1, wherein a peripheral contour of at least one depression extends at least partially parallel to a contour of the inner ring in the peripheral direction of the inner ring, in a region of the peripheral contour that extends essentially in the peripheral direction of the inner ring, in relation to a functionally installed state in a turbomachine.

7. The inner ring according to claim 1, wherein at least one depression has a bone-shaped, bone-like-shaped, hourglass-shaped, or hourglass-like-shaped peripheral contour, in relation to a projection of a peripheral contour of the depression in a tangential plane of the inner ring.

8. The inner ring according to claim 1, wherein at least one depression has a peripheral contour that is completely closed or is open at least at one axial end.

9. The inner ring according to claim 1, wherein at least one depression has a bottom surface, wherein the depression has a constant depth at least partially, at least in the region of the bottom surface, over the entire bottom surface.

10. The inner ring according to claim 1, wherein the inner ring is formed in multiple parts.

11. The inner ring according to claim 1, wherein at least one depression is introduced by a cutting manufacturing method into the inner ring by machining.

12. The inner ring according to claim 1, wherein a compressor stage or turbine stage of a gas turbine, has adjustable guide vanes which are mounted at the inner ring.

13. The inner ring according to claim 12, wherein a guide vane assembly has a seal carrier or a seal carrier segment, wherein the seal carrier or the seal carrier segment is arranged at the inner ring on the side facing away from the guide vanes and covers at least one depression that is arranged in a surface facing away from the guide vanes at least partially.

14. The inner ring according to claim 1, wherein the inner ring is configured and arranged in a turbomachine with at least a compressor stage or turbine stage.

15. The inner ring according to claim 1, wherein at least one depression is produced by milling.

* * * * *